US011318768B2

(12) United States Patent
Satake et al.

(10) Patent No.: US 11,318,768 B2
(45) Date of Patent: May 3, 2022

(54) CLEANING DEVICE AND IMAGE FORMING APPARATUS

(71) Applicant: KYOCERA Document Solutions Inc., Osaka (JP)

(72) Inventors: Kenichi Satake, Osaka (JP); Hiroatsu Tamai, Osaka (JP); Takeshi Watanabe, Osaka (JP); Hiroki Sakane, Osaka (JP); Yusuke Tamekuni, Osaka (JP); Masato Usui, Osaka (JP); Yuzuru Yuasa, Osaka (JP); Yasuhiro Michishita, Osaka (JP); Naoto Miyakoshi, Osaka (JP); Shunsuke Yamasaki, Osaka (JP); Shinobu Ohata, Osaka (JP)

(73) Assignee: KYOCERA Document Solutions Inc.

( * ) Notice: Subject to any disclaimer, the term of this patent is extended or adjusted under 35 U.S.C. 154(b) by 89 days.

(21) Appl. No.: 16/885,915

(22) Filed: May 28, 2020

(65) Prior Publication Data

US 2020/0376871 A1 Dec. 3, 2020

(30) Foreign Application Priority Data

May 30, 2019 (JP) ..... JP2019-101699
Sep. 26, 2019 (JP) ..... JP2019-175378

(51) Int. Cl.
*B41J 29/17* (2006.01)
*G03G 21/10* (2006.01)

(52) U.S. Cl.
CPC ..... *B41J 29/17* (2013.01); *G03G 21/10* (2013.01)

(58) Field of Classification Search
CPC ..... B41J 29/17
See application file for complete search history.

(56) References Cited

U.S. PATENT DOCUMENTS 8,746,865 B2 * 6/2014 Tojo ..... B41J 2/01 347/96
2010/0232849 A1 * 9/2010 Nanataki ..... G03G 15/2025 399/327
2013/0236220 A1 * 9/2013 Mito ..... G03G 15/2025 399/327
2017/0113476 A1 * 4/2017 Hara ..... B41J 29/17

FOREIGN PATENT DOCUMENTS

JP 2006-117420 5/2006

* cited by examiner

*Primary Examiner* — Scott A Richmond
(74) *Attorney, Agent, or Firm* — Gerald E. Hespos; Michael J. Porco; Matthew T. Hespos

(57) ABSTRACT

A cleaning device cleans a surface of a sheet conveyance member that conveys a sheet in an image forming apparatus which executes image forming processing, using a liquid recording material. The cleaning device includes a cleaning member having a contact surface configured to be brought into contact with the surface of the sheet conveyance member. A contact angle of the contact surface with the recording material is smaller than a contact angle of the surface of the sheet conveyance member with the recording material.

7 Claims, 15 Drawing Sheets

CLEANING DEVICE AND IMAGE FORMING APPARATUS

INCORPORATION BY REFERENCE

This application is based on Japanese Patent Application No. 2019-101699 filed with the Japanese Patent Office on May 30, 2019 and Japanese Patent Application No. 2019-175378 filed with the Japanese Patent Office on Sep. 26, 2019, the contents of which are incorporated by reference.

BACKGROUND

Field of the Invention

The present disclosure relates to a cleaning device which cleans a sheet conveyance member, such as a conveyance roller and a conveyance belt that conveys a sheet, and to an image forming apparatus including the cleaning device.

Related Art

The image forming apparatus, such as a printer, includes a sheet conveyance unit which conveys a sheet to an image forming unit that executes image forming processing. The sheet conveyance unit includes, for example, a pair of resist rollers each having a length corresponding to a width of the sheet to be conveyed. The pair of resist rollers forms a nip portion through which the sheet travels. When a distal end portion of the sheet is brought into contact with the nip portion in a state where the rotation of the pair of resist rollers is stopped, skewing of the sheet is straightened. Afterward, when the pair of resist rollers rotates, the sheet is conveyed into the nip portion and then is fed out from there at proper timing matching timing of image forming at the image forming position.

Another example of the sheet conveyance unit is a sheet conveyance unit including a plurality of support rollers and a conveyance belt supported in an extended manner between the plurality of support rollers. The sheet conveyance unit having such a configuration drives the conveyance belt at predetermined timing, thereby conveying the sheet placed on the conveyance belt to the image forming unit.

There is a case where a surface of the sheet conveyance member, such as the resist roller and the conveyance belt, is soiled because of sheet conveyance. Soiling of the surface of the sheet conveyance member may create a problem, such as an image to be printed on the sheet being stained with foreign matter. A conventional cleaning mechanism has been known as a mechanism having a configuration in which a web is brought into contact with a resist roller and a voltage of a predetermined polarity is applied to a pressing roller that presses the web against the resist roller. According to this mechanism, through the above voltage application, a polarity of paper dust adhering to a surface of the resist roller is made reverse to a polarity of the web. This causes the paper dust to stick to the web highly efficiently, thus allowing the web to clean the surface of the resist roller.

SUMMARY

A cleaning device according to an aspect of the present disclosure cleans a surface of a sheet conveyance member that conveys a sheet in an image forming apparatus which executes image forming processing, using a liquid recording material. The cleaning device includes a cleaning member having a contact surface configured to be brought into contact with the surface of the sheet conveyance member. A contact angle of the contact surface with the recording material is smaller than a contact angle of the surface of the sheet conveyance member with the recording material.

An image forming apparatus according to another aspect of the present disclosure includes: an image forming unit that executes image forming processing, using a liquid recording material; a sheet conveyance unit that conveys a sheet to the image forming unit, the sheet conveyance unit including a sheet conveyance member that comes in contact with the sheet; and the above cleaning device.

DETAILED DESCRIPTION

Embodiments of the present disclosure will hereinafter be described with reference to the drawings. The embodiments to be described below are examples of the present disclosure, and the present disclosure, except its essential configurations, is not limited in any form by the following embodiments.

First Embodiment

<Overall Configuration of Image Forming Apparatus>

Figure 1:
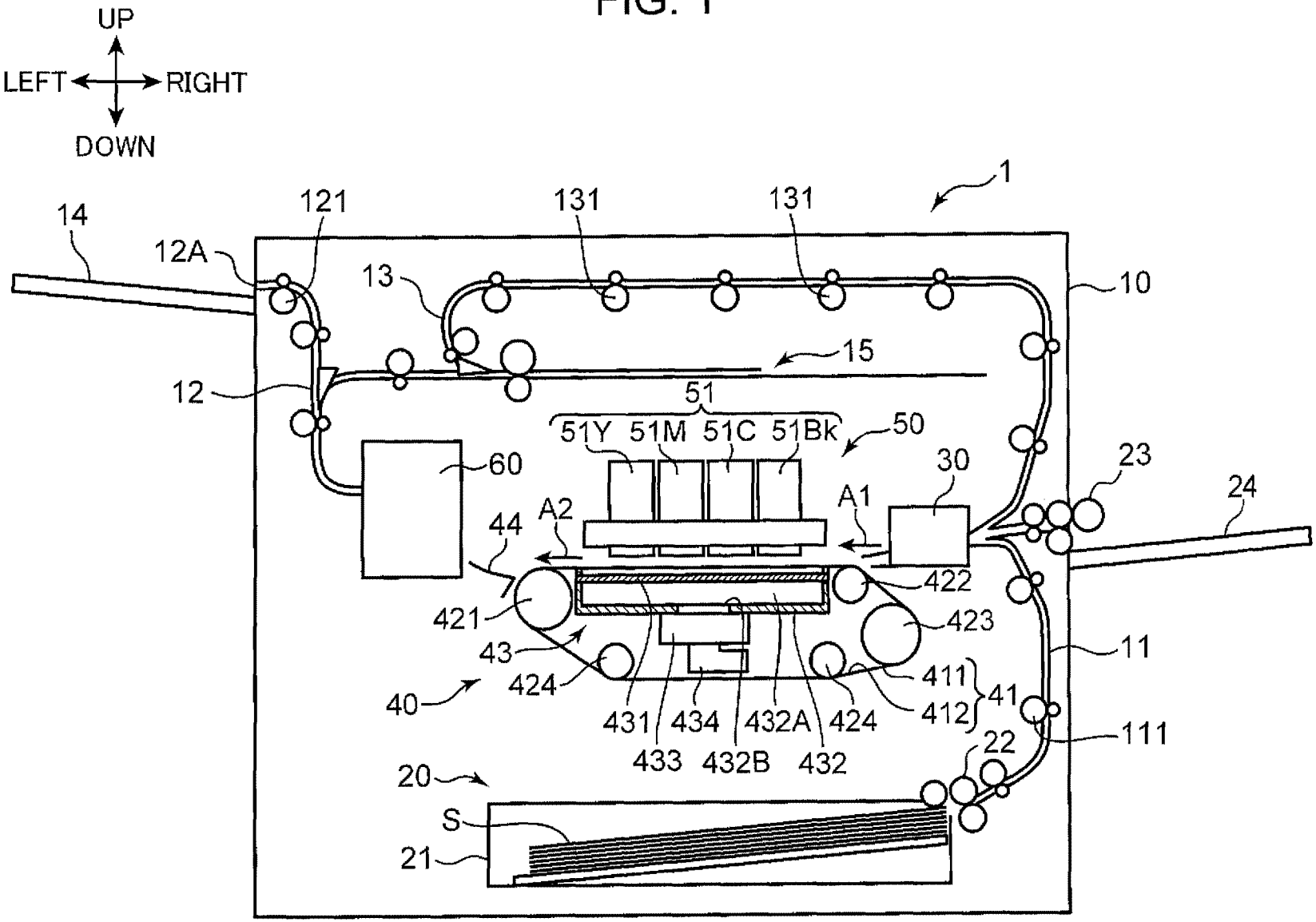
FIG. 1 is a schematic cross-sectional view showing an internal structure of an image forming apparatus according to an embodiment of the present disclosure.

FIG. 1 depicts an internal structure of an image forming apparatus 1 according a first embodiment of the present disclosure. The image forming apparatus 1 shown in FIG. 1 is an ink jet recording apparatus which forms (records) an image on a sheet S by ejecting droplets of water-based ink (liquid recording material). The image forming apparatus 1 includes an apparatus body 10, a paper supply unit 20, a resist roller unit (sheet conveyance unit) 30, a belt conveyance unit 40, an image forming unit 50, and a curl correction unit 60.

The apparatus body 10 is a box-shaped housing that houses various devices for forming an image on the sheet S. In the apparatus body 10, a first conveyance path 11, a second conveyance path 12, and a third conveyance path 13 which form a conveyance path of the sheet S are formed.

The paper supply unit 20 supplies the sheet S to the first conveyance path 11. The paper supply unit 20 includes a paper supply cassette 21 and a paper supply roller 22. The paper supply cassette 21 is detachably mounted on the apparatus body 10 and sheets S are stored in the paper supply cassette 21. The paper supply roller 22 feeds out sheets S stored in the paper supply cassette 21 one by one, by picking a sheet S on an uppermost layer of a bundle of sheets S and sending the sheet S out to a first conveyance path 11.

The sheet S supplied to the first conveyance path 11 is conveyed by a pair of first conveyance rollers 111 provided on the first conveyance path 11, to a resist roller unit 30 disposed on a downstream side of the first conveyance path 11. A paper supply tray 24 is disposed on a right side surface of the apparatus body 10, and sheets S can be manually placed on an upper surface of the paper supply tray 24. The sheets S placed on the paper supply tray 24 are fed out toward the resist roller unit 30 by the paper supply roller 23.

The resist roller unit 30 is a device that conveys the sheet S, which is fed to the resist roller unit 30 through the first conveyance path 11 or the paper supply roller 23, toward a conveyance belt 41 of the belt conveyance unit 40 in a sheet conveyance direction A1. Details of the resist roller unit 30 are described later.

When a distal end of the sheet S conveyed by the resist roller unit 30 comes in contact with an outer peripheral surface 411 of the conveyance belt 41, the sheet S is then conveyed by the conveyance belt 41, which is being driven, in a sheet conveyance direction A2 in a state where the sheet S is held on the outer peripheral surface 411. The sheet conveyance direction A2 is a direction in which the sheet S is conveyed from the right side to the left side in a left-right direction.

The belt conveyance unit 40 is disposed under the image forming unit 50 so as to face line heads 51. The belt conveyance unit 40 conveys the sheet S, which is conveyed by the resist roller unit 30, in the sheet conveyance direction A2 toward the curl correction unit 60 such that the sheet S passes under the image forming unit 50. The belt conveyance unit 40 has the conveyance belt 41 and a suction unit 43.

The conveyance belt 41 is an endless belt having a width in a front-rear direction (direction orthogonal to the paper surface in FIG. 1) and extending in a left-right direction. The conveyance belt 41 is disposed so as to face the image forming unit 50, and conveys the sheet S in the sheet conveyance direction A2 on an outer peripheral surface 411. More specifically, in a predetermined conveyance area facing the line heads 51 of the image forming unit 50, the conveyance belt 41 conveys the sheet S held on its outer peripheral surface 411, in the sheet conveyance direction A2. An image forming position, at which the line heads 51 of the image forming unit 50 carry out image forming processing, is set on an orbital movement path of the conveyance belt 41.

The conveyance belt 41 is supported in an extended manner between and by the first support roller 421, the second support roller 422, the third support roller 423, and the pair of fourth support rollers 424. Inside the conveyance belt 41 supported in an extended manner as described above, the suction unit 43 is disposed so as to face an inner peripheral surface 412. The first support roller 421 is a drive roller extending in the front-rear direction that is a width direction of the conveyance belt 41. In the sheet conveyance direction A2, the first support roller 421 is disposed downstream to the suction unit 43. The first support roller 421 is rotatably driven by a drive motor (not shown), and allows the conveyance belt 41 to orbit in a predetermined orbital direction. As a result of an orbital movement of the conveyance belt 41, the sheet S held on the outer peripheral surface 411 of the conveyance belt 41 is conveyed in the sheet conveyance direction A2.

The second support roller 422 is a belt speed detection roller extending in the front-rear direction. In the sheet conveyance direction A2, the second support roller 422 is disposed upstream to the suction unit 43. The second support roller 422 is disposed such that the second support roller 422 cooperates with the first support roller 421 to maintain the planarity of an area of the outer peripheral surface 411 of the conveyance belt 41, the area facing the line heads 51, and the planarity of an area of the inner peripheral surface 412 of the conveyance belt 41, the area facing the suction unit 43. On the outer peripheral surface 411 of the conveyance belt 41, an area facing the line heads 51 and located between the first support roller 421 and the second support roller 422 serves as the above predetermined conveyance area where the sheet S held on the outer peripheral surface 411 is conveyed. The second support roller 422 is driven to rotate in a movement interlocked with the orbiting of the conveyance belt 41. The second support roller 422 is fitted with a pulse plate (not shown). This pulse plate rotates integrally with the second support roller 422. By measuring a rotating speed of the pulse plate, a rotating speed of the conveyance belt 41 is detected.

The third support roller 423 is a tension roller extending in the front-rear direction, and gives the conveyance belt 41 a tensile force to prevent the conveyance belt 41 from slacking. The third support roller 423 is driven to rotate in a movement interlocked with the orbiting of the conveyance belt 41. Each of the pair of fourth support rollers 424 is a guide roller extending in the front-rear direction, and guides the conveyance belt 41 to cause it to pass under the suction unit 43. The pair of fourth support rollers 424 is driven to rotate in a movement interlocked with the orbiting of the conveyance belt 41. The conveyance belt 41 has a plurality of suction holes penetrating the conveyance belt 41 in its thickness direction from the outer peripheral surface 411 to the inner peripheral surface 412.

The suction unit 43 is disposed so as to face the image forming unit 50 with the conveyance belt 41 interposed between the suction unit 43 and the image forming unit 50. The suction unit 43 brings the sheet S, which is held on the outer peripheral surface 411 of the conveyance belt 41, into close contact with the outer peripheral surface 411 of the conveyance belt 41 by generating a negative pressure between the sheet S and the conveyance belt 41. The suction unit 43 includes a belt guide member 431, a suction housing 432, a suction device 433, and an exhaust duct 434.

The belt guide member 431 is disposed so as to face an area of the inner peripheral surface 412 of the conveyance belt 41, the area being located between the first support roller 421 and a second support roller 422. The belt guide member 431 is a plate-like member having a width substantially equal to a length of the conveyance belt 41 in its width direction (front-rear direction). The belt guide member 431 forms an upper surface portion of the suction housing 432, and has a shape that is substantially equal to a shape of the suction housing 432 when seen from above. The belt guide member 431 guides the orbital movement of the conveyance belt 41 in an interlocking manner with the rotation of the first support roller 421 between the first support roller 421 and the second support roller 422.

The belt guide member 431 has a plurality of groove portions formed on a belt guide surface facing the inner peripheral surface 412 of the conveyance belt 41. The groove portions are formed so as to correspond respectively to the suction holes of the conveyance belt 41. The belt guide member 431 further has through-holes formed so as to correspond respectively to the groove portions. Each through-hole is a hole that in each groove portion, penetrates the belt guide member 431 in its thickness direction. Each through-hole thus communicates with each suction hole of the conveyance belt 41 across each groove portion.

The suction unit 43 configured in the above manner generates a suction force by sucking air from a space above the conveyance belt 41 through the groove portions and through-holes of the belt guide member 431 and the suction holes of the conveyance belt 41. Due to such a suction force, an airflow (suction air) toward the suction unit 43 is generated in the space above the conveyance belt 41. When the sheet S is conveyed onto the conveyance belt 41 by the resist roller unit 30 and covers a part of the outer peripheral surface 411 of the conveyance belt 41, a suction force (negative pressure) acts on the sheet S, and the sheet S is brought into close contact with the outer peripheral surface 411 of the conveyance belt 41.

The suction housing 432 is a box-shaped housing having an upper opening, and the suction housing 432 is disposed below the conveyance belt 41 such that the upper opening is covered by the belt guide member 431. The suction housing 432 defines a suction space 432A in cooperation with the belt guide member 431. This means that a space enclosed with the suction housing 432 and the belt guide member 431 serves as the suction space 432A. This suction space 432A communicates with the suction holes of the conveyance belt 41 through the groove portions and through-holes of the belt guide member 431.

An opening portion 432B is formed in a bottom wall portion of the suction housing 432, and the suction device 433 is disposed corresponding to the opening portion 432B. The exhaust duct 434 is connected to the suction device 433. The exhaust duct 434 is connected to an exhaust port (not shown) formed in the apparatus body 10.

The image forming unit 50 is disposed above the belt conveyance unit 40. Specifically, above the belt conveyance unit 40, the image forming unit 50 is disposed so as to face the outer peripheral surface 411 of the conveyance belt 41. The image forming unit 50 forms an image by applying image forming processing to the sheet S which is conveyed in the sheet conveyance direction A2 in a state where the sheet S is held on the outer peripheral surface 411 of the conveyance belt 41. In the present embodiment, an image forming method of the image forming unit 50 is an ink jet method, according to which an image is formed on the sheet S by ejecting droplets of water-based ink (recording material).

The image forming unit 50 includes line heads 51 (51Bk, 51C, 51M, 51Y). The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are arranged adjacent to each other from an upstream side to a downstream side in the sheet conveyance direction A1. Each of the line heads 51Bk, 51C, 51M, and 51Y ejects ink droplets on the sheet S conveyed in the sheet conveyance direction A2 in a state where the sheet S is held on the outer peripheral surface 411 of the conveyance belt 41, thereby forming an image on the sheet S. As a result, an image is formed on the sheet S.

The sheet S on which the image is formed is conveyed by the conveyance belt 41, and is guided by a discharge guide unit 44 to enter the curl correction unit 60. The curl correction unit 60 is disposed downstream of the conveyance belt 41 in the sheet conveyance direction A2 with the discharge guide unit 44 sandwiched therebetween. The curl correction unit 60 corrects the curl of the sheet S on which the image is formed while conveying the sheet S to the downstream side.

The sheet S whose curl has been corrected by the curl correction unit 60 is fed out to the second conveyance path 12. The second conveyance path 12 extends along a left side surface of the apparatus body 10. The sheet S fed out to the second conveyance path 12 is conveyed by a pair of second conveyance rollers 121 disposed on the second conveyance path 12 toward a paper discharge port 12A formed on a left side of the apparatus body 10, and the sheet S is discharged onto a paper discharge unit 14 from the paper discharge port 12A.

In a case where both-side printing is applied to the sheet S, meanwhile, the sheet S, whose front surface has been subjected to the image forming processing, is fed out from the second conveyance path 12 toward a sheet reversing unit 15. The sheet reversing unit 15 is a conveyance path branching out from a midpoint of the second conveyance path 12, serving as a part where the sheet S is reversed in surface position and conveyance direction (switchback). The sheet S reversed by the sheet reversing unit 15 to have its front and back surfaces switched to each other is fed out to a third conveyance path 13, on which the sheet S is conveyed in a reverse direction by a pair of third conveyance rollers 131 disposed on the third conveyance path 13. Subsequently, the sheet S travels through the resist roller unit 30 and is re-supplied onto the outer peripheral surface 411 of the conveyance belt 41 in a state where the sheet S is reversed to have its front and back surfaces switched to each other. The re-supplied sheet S is conveyed by the conveyance belt 41 as the image forming processing is applied to the back surface of the sheet S by the image forming unit 50. The sheet S on which both-side printing has been completed passes through the second conveyance path 12, and is discharged onto the paper discharge unit 14 from the paper discharge port 12A.

<Structure of Resist Roller Unit and its Surroundings>

Figure 2:
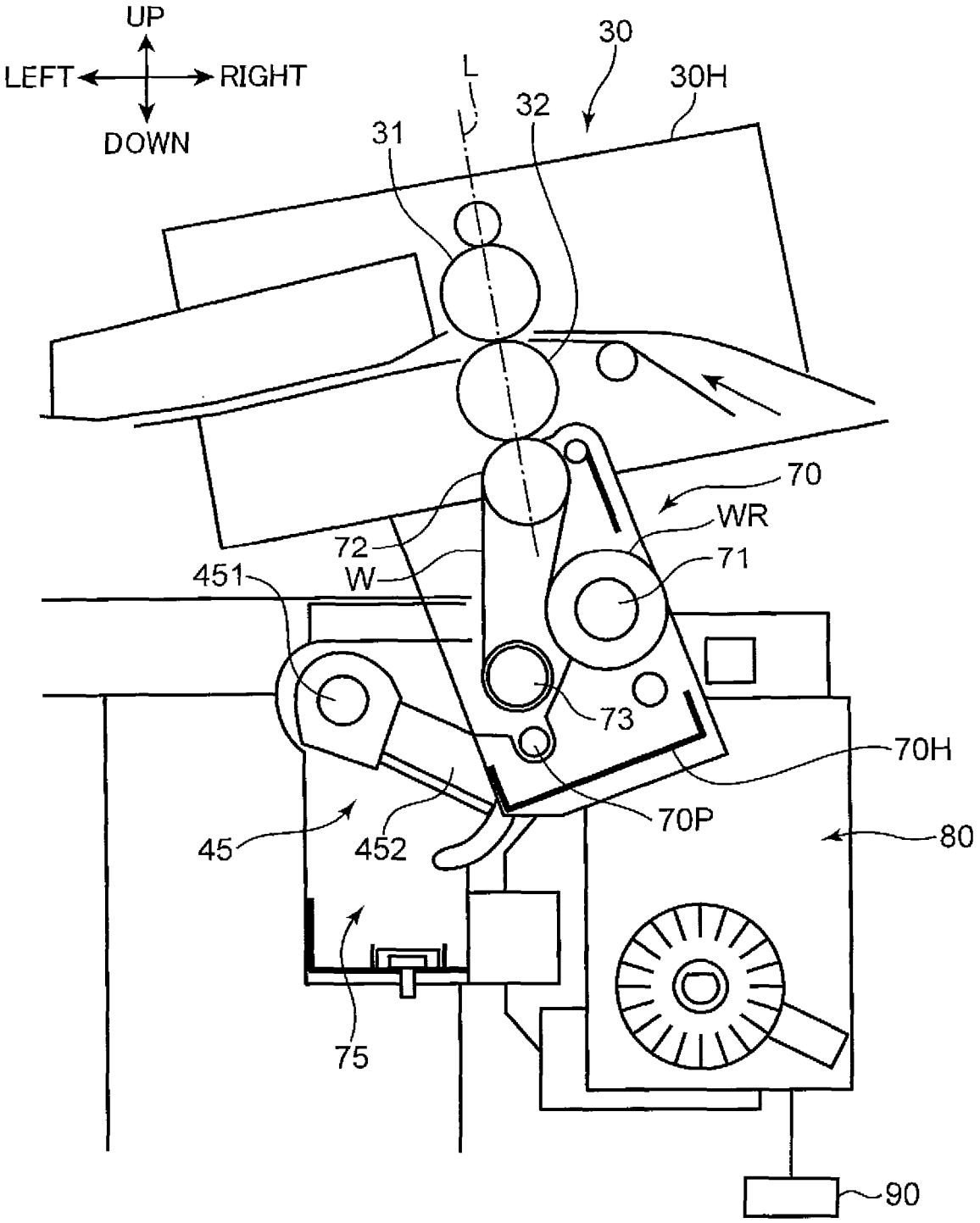
FIG. 2 is a cross-sectional view showing a structure of a resist roller unit, a cleaning unit, and their surroundings.

FIG. 2 shows a structure of the resist roller unit 30 and its surroundings. As shown in FIG. 2, the resist roller unit 30 has a resist housing 30H, and a pair of resist rollers consisting of a resist upper roller 31 and a resist lower roller 32 (sheet conveyance member). The resist housing 30H is mounted on the apparatus body 10, and rotatably supports the resist upper roller 31 and the resist lower roller 32. In the resist housing 30H, the sheet S is conveyed into a nip portion formed between the pair of resist rollers consisting of the resist upper roller 31 and the resist lower roller 32. The resist roller unit 30 has a roller drive unit (not shown) that drives the resist upper roller 31 and the resist lower roller 32 to rotate.

The resist upper roller 31 is a metal roller made of, for example, an aluminum alloy. The resist lower roller 32 is formed by coating an outer periphery of a roller base material made of, for example, a rubber, such as ethylene-propylene-diene rubber (EPDM), with a highly water-repellent tube made of, for example, a tetrafluoroethylene-perfluoroalkoxyethylene copolymer resin (PFA). The resist lower roller 32 forms the nip portion between the resist lower roller 32 and the resist upper roller 31, the nip portion allowing the sheet S to travel therethrough, and conveys the sheet S toward the image forming unit 50 at timing matching timing of the image forming processing.

As shown in FIG. 2, a virtual straight line L connecting the center of the resist upper roller 31 and the center of the resist lower roller 32 is inclined at an acute angle (e.g., 10 degrees) with respect to a vertical direction. In other words, the resist lower roller 32 is disposed at the position displaced upstream in a conveyance direction of the sheet S with respect to the resist upper roller 31.

When the above both-side printing is carried out, the sheet S having been subjected to single-side printing is reversed to have its front and back surfaces switched to each other, and is conveyed into the nip portion of the pair of resist rollers. As a result, the resist lower roller 32 comes in contact with a printed surface of the sheet S. At this time, undried ink adheres to a surface of the resist lower roller 32 in some cases. Such a case leads to a problem that ink adhering to the resist lower roller 32 is transferred to another incoming sheet S when it travels through the pair of resist rollers. Another concern is that the resist lower roller 32 disposed on the lower side out of the pair of resist rollers is a roller that allows foreign matter, such as paper dust, to adhere thereto easily.

In view of the above circumstances, the image forming apparatus 1 according to the present embodiment is provided with a cleaning unit 70 (cleaning device) and with a movement mechanism 75. The cleaning unit 70 can clean a surface of the resist lower roller 32. The cleaning unit 70, of which a detailed structure will be described later, includes a web driven roller 71, a pressing roller 72, a web drive roller 73, a cleaning housing 70H that pivotally supports these rollers 71 to 73, and a web W.

The web W is a strip-shaped member forming a contact surface that comes in contact with the surface of the resist lower roller 32 to clean up the surface. The web W is made of a fabric material, such as nonwoven fabric, and is rolled in advance into a web roll WR, which is fitted on the exterior of the web driven roller 71. The web W is fed out by fixed amount from the web roll WR fitted on the web driven roller 71, travels the pressing roller 72 past, and is rolled up around the web drive roller 73. The web W is supported in an extended manner between the web driven roller 71, the pressing roller 72, and the web drive roller 73 so as to have no slackness.

The movement mechanism 75 (FIG. 2) is a mechanism that allows the cleaning unit 70 to be moved between a cleaning position (FIG. 2) and a mounting and removing position (FIG. 7) below the cleaning position. At the cleaning position, the movement mechanism 75 allows the web W of a cleaning part 70A to come in contact with the resist lower roller 32. At the mounting and removing position, the movement mechanism 75 allows the cleaning part 70A to be disposed below the resist lower roller 32 in a separated manner and allows the cleaning unit 70 to be mounted and removed on and from the apparatus body 10. The movement mechanism 75 can cause the cleaning unit 70 to stay at a separation position located at a midpoint between the cleaning position and the mounting and removing position. At the separation position, the cleaning part 70A is disposed below the resist lower roller 32 in a separated manner as the cleaning unit 70 is disconnected from a web feed-out mechanism.

The movement mechanism 75 has a cleaning unit rotating unit 45 and a unit driving unit 80 that cause the cleaning unit 70 to rotate such that the cleaning unit 70 changes its orientation between the cleaning position and the mounting and removing position. The cleaning unit rotating unit 45 includes a rotary shaft 451 supported on the conveyance unit frame 40H holding the belt conveyance unit 40, and a pair of front and rear rotary levers 452 fitted respectively to front and rear parts of the rotary shaft 451.

The unit driving unit 80 includes a drive motor (not shown), and generates a drive force for rotating the rotary shaft 451 around its center axis. Being driven by rotation of the drive motor, the rotary shaft 451 is caused to rotate by a predetermined angle. To the drive motor of the unit driving unit 80, a controller 90 is connected. The drive motor is rotatably driven according to a control signal from the controller 90. The controller 90 is configured such that in a computer system including a CPU, ROM, RAM and the like, the controller 90 executes a predetermined operation program.

The rotary levers 452 have pin receiving portions 452P (FIG. 8) formed respectively thereon. The pin receiving portions 452P receive unit fulcrum pins 70P protruding in the front-rear direction from front and rear parts of the cleaning unit 70, respectively, and rotatably support the unit fulcrum pins 70P. The cleaning unit 70 is controlled in orientation to take its respective orientations at three positions, i.e., the cleaning position, the separation position, and the mounting and removing position, according to angels of rotation of the rotary shaft 451 rotated by the unit driving unit 80. A state shown in FIG. 2 is a state where the cleaning unit 70 is at the cleaning position at which the pressing roller 72 is in contact with the resist lower roller 32 with the web W sandwiched between the pressing roller 72 and the resist lower roller 32.

When the cleaning unit 70 is at the separation position, the pressing roller 72 is disposed below in a separated manner so that the web W is separated from the resist lower roller 32. When the cleaning unit 70 is at the mounting and removing position, the pressing roller 72 is disposed further below in a separated manner.

<Detailed Structure of Cleaning Unit>

Figure 3:
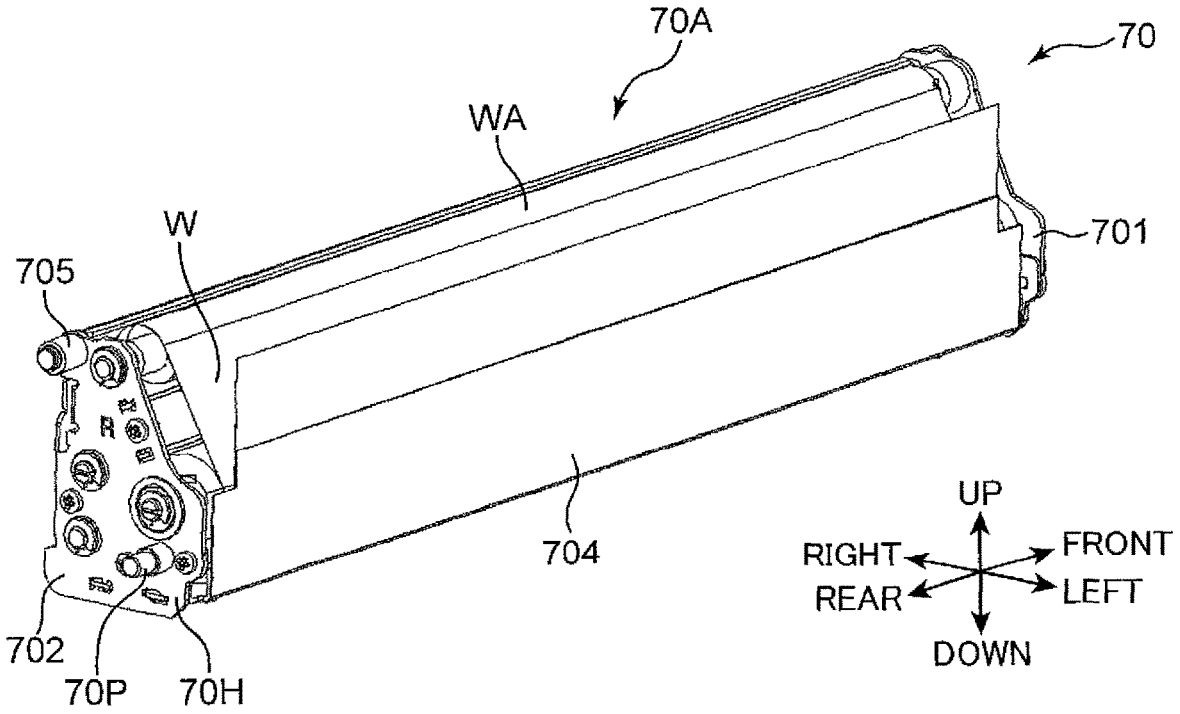
FIG. 3 is a perspective view showing an external structure of the cleaning unit.
Figure 4:
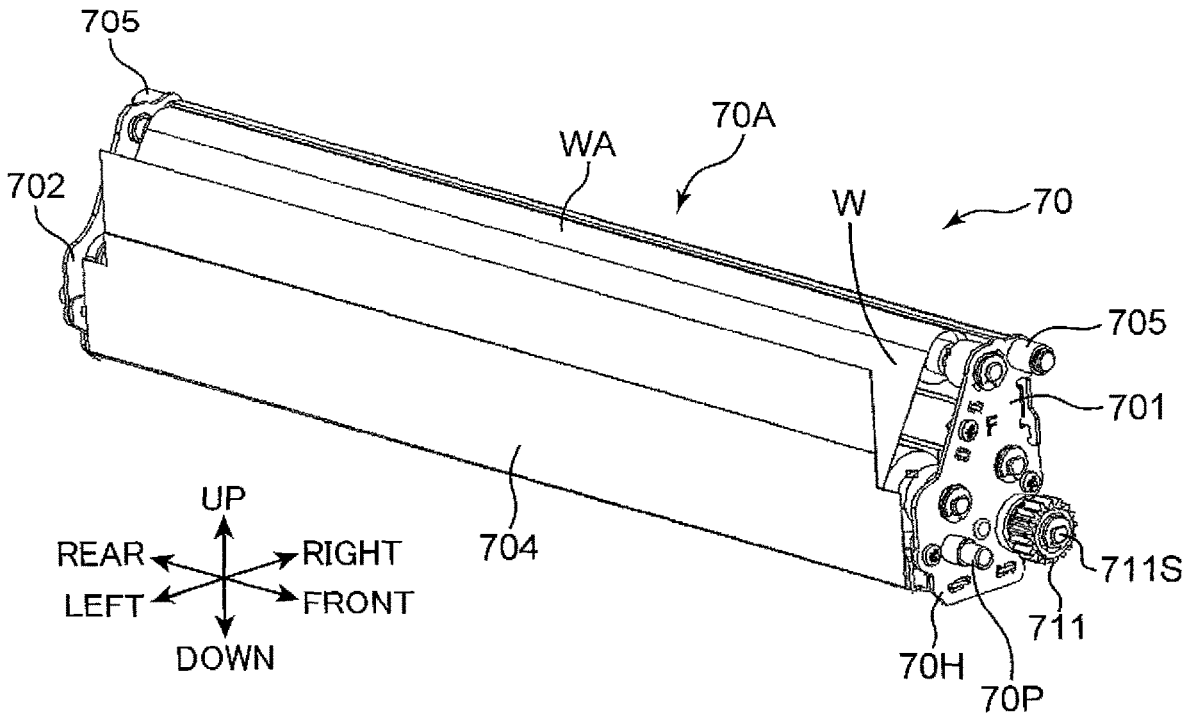
FIG. 4 is a perspective view showing an external structure of the cleaning unit.
Figure 5:
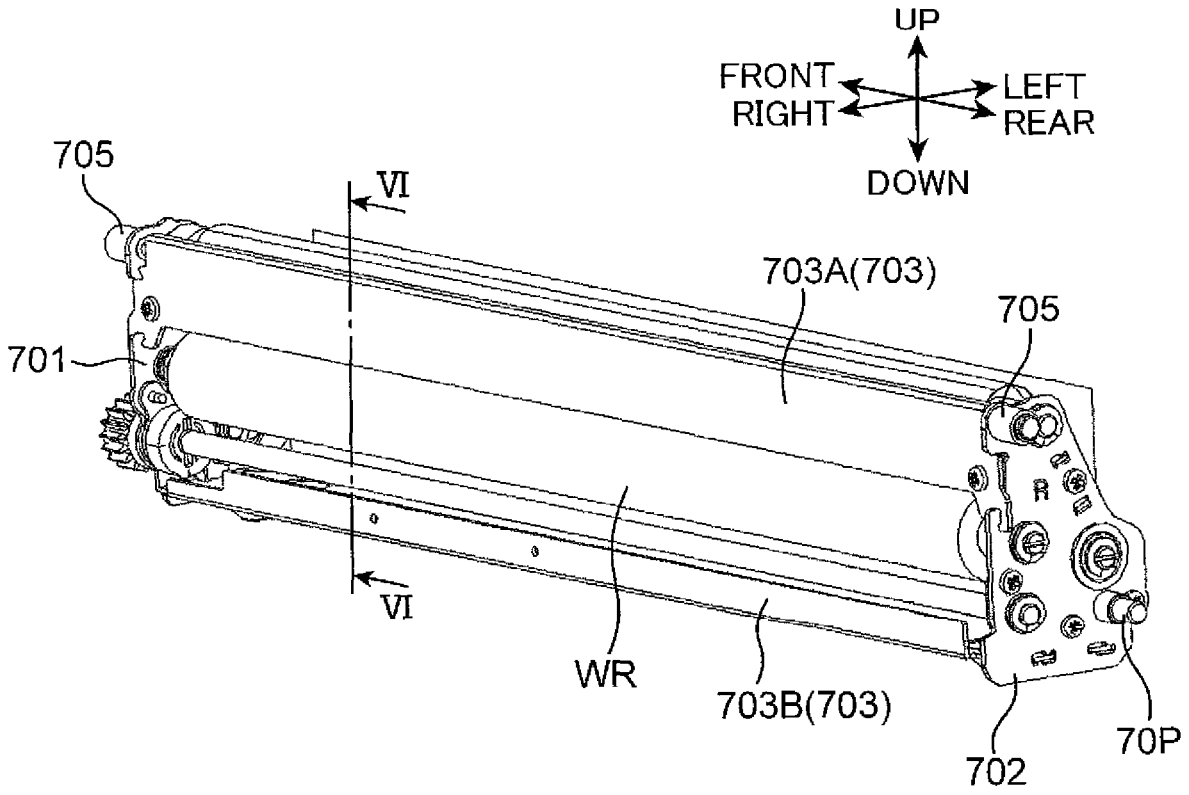
FIG. 5 is a perspective view showing an external structure of the cleaning unit.
Figure 6:
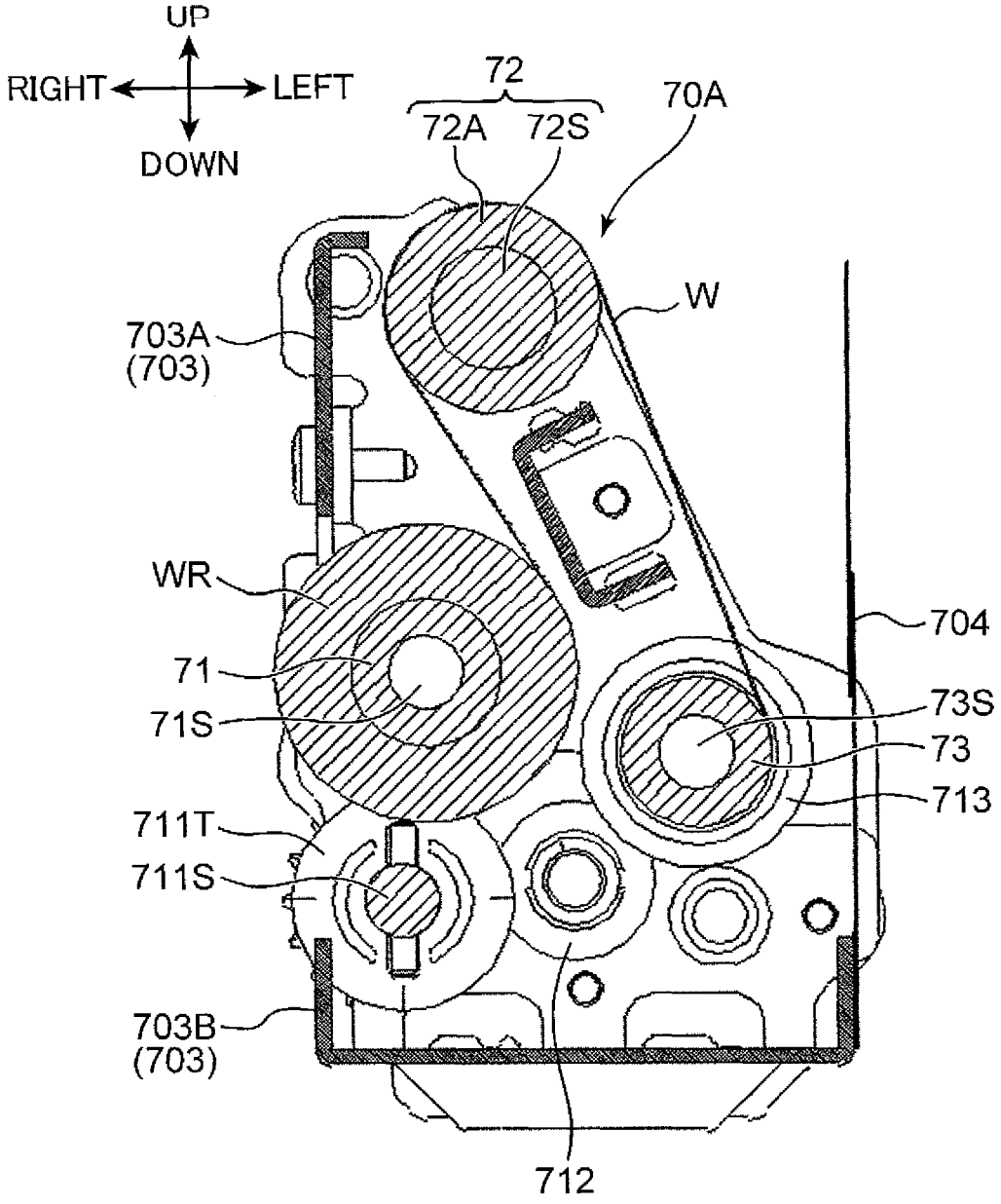
FIG. 6 is a cross-sectional view taken along line VI-VI in FIG. 5.

FIGS. 3 to 5 are perspective views of an external structure of the cleaning unit, showing the external structure of the cleaning unit seen in different directions. FIG. 6 is a cross-sectional view taken along line VI-VI in FIG. 5. The cleaning unit 70 includes the cleaning part 70A and the cleaning housing 70H. The cleaning part 70A has a contact surface WA extending along an axial direction of the resist lower roller 32. The cleaning part 70A is disposed such that the contact surface WA comes in contact from below with the surface of the resist lower roller 32, and the contact surface WA wipes out the surface of the resist lower roller 32 to clean up the surface.

The cleaning housing 70H supports the cleaning part 70A. The cleaning housing 70H has a front wall 701 and a rear wall 702, a connection wall 703, the pair of unit fulcrum pins 70P, a sheet member 704, and a pair of guide rollers 705. The front wall 701, the rear wall 702, and the connection wall 703 of the cleaning housing 70H are made of a metal material (magnetic material).

The front wall 701 and the rear wall 702 are disposed so as to face each other in the front-rear direction (the axial direction of the resist lower roller 32), and support the cleaning part 70A. The connection wall 703 connects the front wall 701 to the rear wall 702 along the front-rear direction. The connection wall 703 has a side wall 703A making up an upper right side surface of the cleaning housing 70H, and a bottom wall 703B making up a bottom surface of the cleaning housing 70H (see FIG. 6).

The pair of unit fulcrum pins 70P protrude in the front-rear direction from an outer surface of the front wall 701 and the same of the rear wall 702, respectively. The unit fulcrum pins 70P are disposed on a left lower portion of the front wall 701 and the same of the rear wall 702, respectively. Each unit fulcrum pin 70P has a circular cylindrical shape in two stages where an outer diameter of the unit fulcrum pin 70P decreases from a base portion toward a distal end portion.

The sheet member 704 is a film-like member making up a left side surface of the cleaning housing 70H, and is fixed to the bottom wall 703B (FIG. 6). The sheet member 704 prevents foreign matter, such as paper dust and ink pigment, collected by the cleaning unit 70 from scattering in the apparatus body 10.

Above the unit fulcrum pins 70P, the pair of guide rollers 705 are supported by the front wall 701 and the rear wall 702, respectively, and each include an outer peripheral surface rotatable around a center axis parallel to the front-rear direction. The guide rollers 705 are disposed on right upper portions of the front wall 701 and the rear wall 702 respectively. The pair of guide rollers 705 has a function of guiding the cleaning unit 70 when the cleaning unit 70 moves to the cleaning position, the separation position, and the mounting and removing position described above.

The cleaning part 70A includes the web W, and the web driven roller 71 (feed-out roller), the pressing roller 72, and the web drive roller 73 (take-up roller) that are supported rotatably by the front wall 701 and the rear wall 702. The web W is a strip-shaped member forming the above contact surface WA, which comes in contact with the surface of the resist lower roller 32 to clean up the surface. A feed-out distal end of the web W is put over an outer peripheral surface of the pressing roller 72 and then is fixed to an outer peripheral surface of the web drive roller 73.

As described above, the web W of a strip shape is reeled out from the web roll WR fitted on the web driven roller 71. The web roll WR is arranged such that an amount of the remaining web W can be visually recognized from the outside of the cleaning unit 70 through an opening portion formed between the side wall 703A and the bottom wall 703B. This prevents a case where the cleaning unit 70 having been removed from the apparatus body 10 during use of the image forming apparatus 1 because of having a little amount of the remaining web W to be used is mounted erroneously on the apparatus body 10.

The pressing roller 72 is in contact with a back surface of the web W and presses a front surface of the web W against the resist lower roller 32. On a movement path of the web W, the pressing roller 72 lies at a midpoint between the web driven roller 71 and the web drive roller 73. The pressing roller 72 is an elastic roller constructed by fitting an elastic material 72A on a peripheral surface of a pressing roller shaft 72S. The pressing roller shaft 72S is a metal shaft, and may be provided as, for example, a shaft made of an iron solid material. The elastic material 72A may be provided as, for example, a sponge member made of an ethylene-propylene-diene rubber (EPDM) foam. When the cleaning unit 70 is disposed at the above cleaning position (FIG. 2), the pressing roller 72 is brought into contact with the resist lower roller 32 with the web W sandwiched between the pressing roller 72 and the resist lower roller 32. At this time, a center of the pressing roller 72 is on the straight line L. The above contact surface WA is a contact portion where the web W comes in contact with the resist lower roller 32, the contact portion being a part of a nip portion formed between the pressing roller 72 and the resist lower roller 32 so as to be on the straight line L, and is a strip-shaped portion extending in the front-rear direction.

The web driven roller 71 is a roller that can be driven to rotate around an axis of a driven roller shaft 71S. The web driven roller 71 feeds out the web W so as to cause a part of the web W that comes in contact with the resist lower roller 32 to shift. The web drive roller 73 takes up the web W having been fed out from the web driven roller 71. The web drive roller 73 is a roller that rotates around an axis of a drive roller shaft 73S, which is supplied with a rotational drive force from a drive system.

The cleaning unit 70 has a unit input gear 711 (see FIG. 4), an interlocking gear 711T, a transmission gear 712, and a drive roller gear 713 (see FIG. 6), which make up the above drive system. The unit input gear 711 is rotatably supported at a lower right end portion of the front wall 701. An input gear shaft 711S of the unit input gear 711 penetrates the front wall 701 and extends to the inside (back side) of the front wall 701. The interlocking gear 711T is fixed to the input gear shaft 711S, and rotates integrally with the unit input gear 711. The transmission gear 712 is rotatably supported inside the front wall 701, and is engaged with the interlocking gear 711T and with the drive roller gear 713. The drive roller gear 713 is a gear fixed to one end portion of the web drive roller 73.

The web W is fed out by a predetermined amount from the web roll WR at predetermined timing, by the web feed-out mechanism. This process is not described in detail. The web feed-out mechanism has a function of giving the drive roller shaft 73S a rotational drive force to feed out the web W. The web feed-out mechanism includes a solenoid that serves as a driving source, and a drive transmission system that coverts an extending and retracting motion of an extendable and retractable shaft of the solenoid into a torque and that transmits the torque to the unit input gear 711.

<Forms of Movement of Cleaning Unit>

Figure 7:
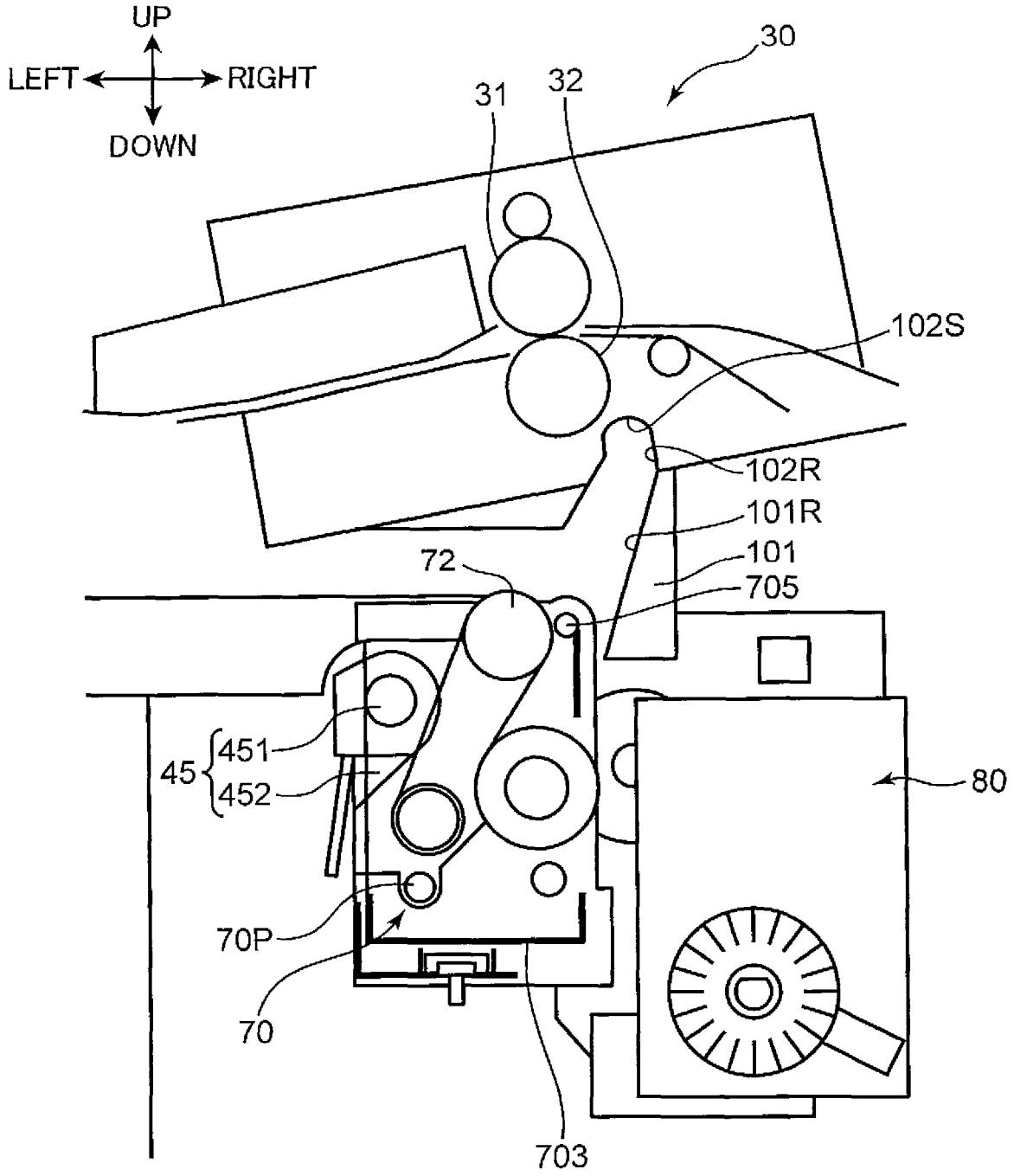
FIG. 7 shows the resist roller unit and the cleaning unit in a state where the cleaning unit is at a mounting and removing position.
Figure 8:
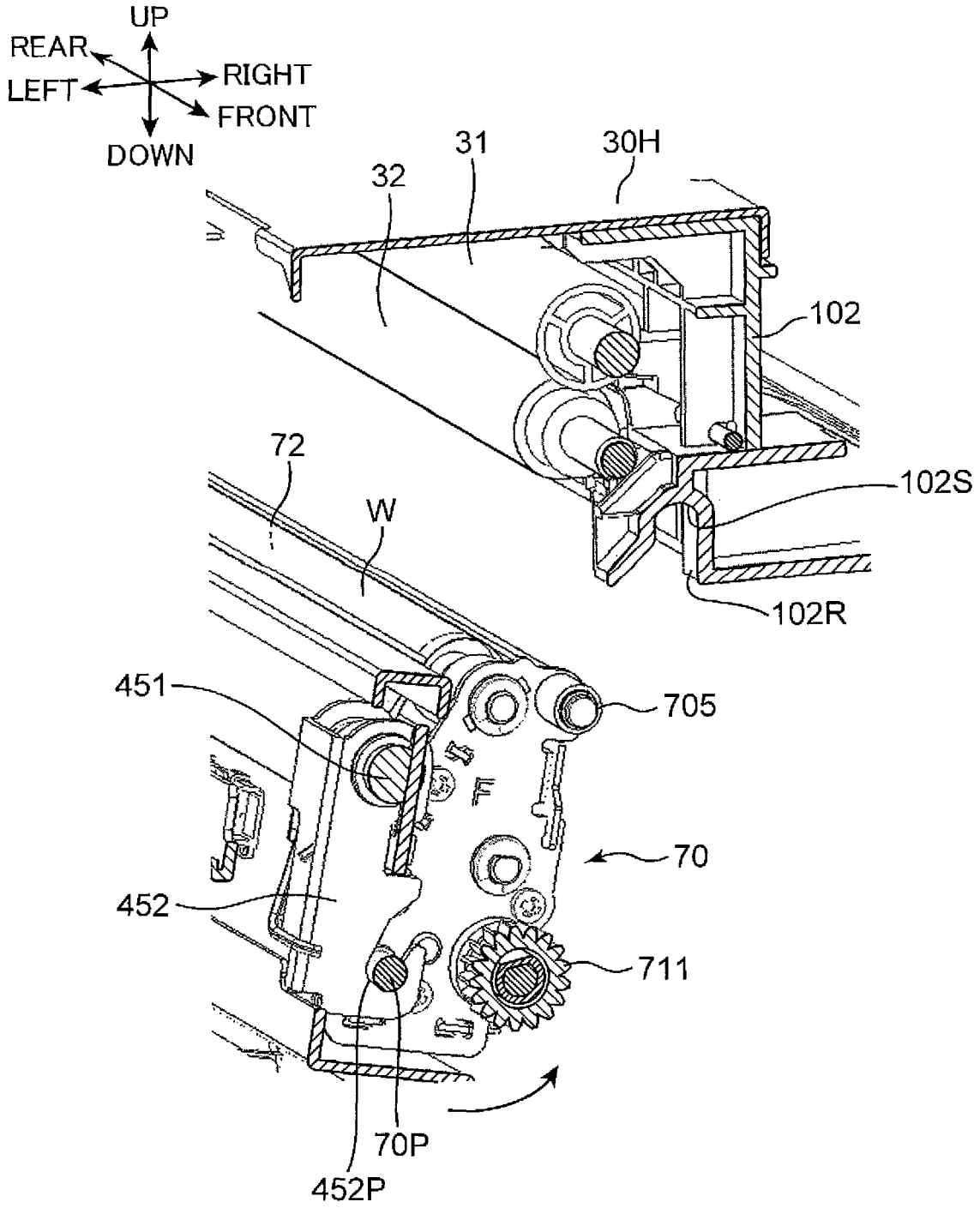
FIG. 8 is a partial cross-sectional view showing the resist roller unit and the cleaning unit in a state where the cleaning unit is slightly pushed up in a right diagonal direction, from the mounting and removing position.
Figure 9:
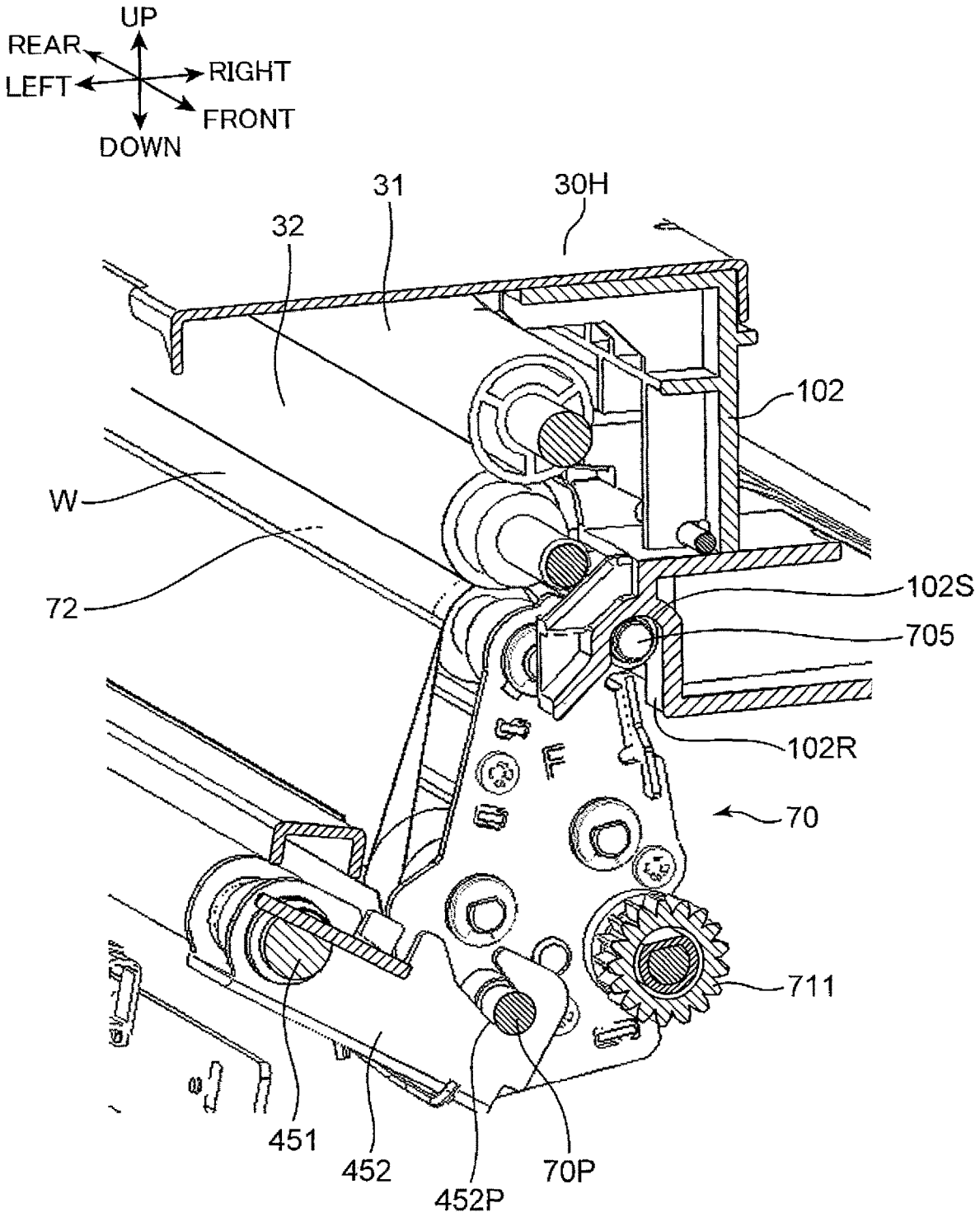
FIG. 9 is a partial cross-sectional view showing the resist roller unit and the cleaning unit in a state where the cleaning unit is at a cleaning position.

As described above, the cleaning unit 70 of the image forming apparatus 1 according to the present embodiment can be moved among the cleaning position, the separation position, and the mounting and removing position. Forms of movement of the cleaning unit 70 to respective positions will be described with reference to FIGS. 7 to 9. FIG. 7 shows the cleaning unit 70 and its surroundings in a state where the cleaning unit 70 is at the mounting and removing position. FIG. 8 is a partial cross-sectional view showing the resist roller unit 30 and the cleaning unit 70 in a state where the cleaning unit 70 is slightly pushed up in an upper diagonal direction, from the mounting and removing position, and FIG. 9 is a partial cross-sectional view showing the resist roller unit 30 and the cleaning unit 70 in a state where the cleaning unit 70 is at the cleaning position.

As shown in FIG. 8, the unit fulcrum pins 70P of the cleaning unit 70 are engaged with the pin receiving portions 452P formed on parts of rotary levers 452 that are close to their distal ends, respectively. As a result of the rotary shaft 451 being rotatably driven by the drive motor (not shown) included in the unit driving unit 80, the distal ends of the rotary levers 452 rotate counterclockwise. The cleaning unit 70 is thus pushed up in the right diagonal direction in a movement interlocked with the rotation of the rotary levers 452. When the rotary shaft 451 is driven to rotate in reverse, the rotary levers 452 rotate clockwise, which causes the cleaning unit 70 to move down leftward.

At this stage of operation, the unit fulcrum pins 70P of the cleaning unit 70 are disposed below and left to a center of gravity of the cleaning unit 70. As a result, when the cleaning unit 70 is pushed up, the cleaning unit 70 takes an orientation where an upper part of the cleaning unit 70 tilts rightward.

As shown in FIG. 7, guide frames 101 are provided in a part that is between the resist roller unit 30 and the unit driving unit 80 and that is above the cleaning unit 70 in the right diagonal direction. On respective left side portions of the guide frames 101, guide surfaces 101R are formed as sloped surfaces. The guide surfaces 101R are guide surfaces for guiding the pair of guide rollers 705, which are disposed on a right upper corner of the cleaning unit 70, to guide surfaces 102R formed on a lower part of the resist frame 102.

When the cleaning unit 70 at the mounting and removing position (FIG. 2) is pushed up by the rotation of the rotary levers 454, the cleaning unit 70 tilts rightward because of the above-described positional difference between the unit fulcrum pins 70P and the center of gravity. This brings the pair of guide rollers 705 into contact with the guide surfaces 101R, along which the guide rollers 705 are guided. Then, when the rotary levers 454 rotate further, the pair of guide rollers 705, which have been guided along the guide surfaces 101R and the guide surfaces 102R, are pushed into positioning portions 102S of the resist frame 102 (see FIG. 9). At a point of time at which the pair of guide rollers 705 are pushed into the positioning portions 102S, the cleaning unit 70 is disposed at the cleaning position and is stopped from moving relative to the resist roller unit 30.

The separation position of the cleaning unit 70 refers to an intermediate position of the cleaning unit 70, the intermediate position being located between the position of the cleaning unit 70 shown in FIG. 8 and the same shown in FIG. 9. The separation position can be set properly as any given position at which the web W is separated from the resist lower roller 32.

<Cleaning Process by Cleaning Unit>

Figure 10:
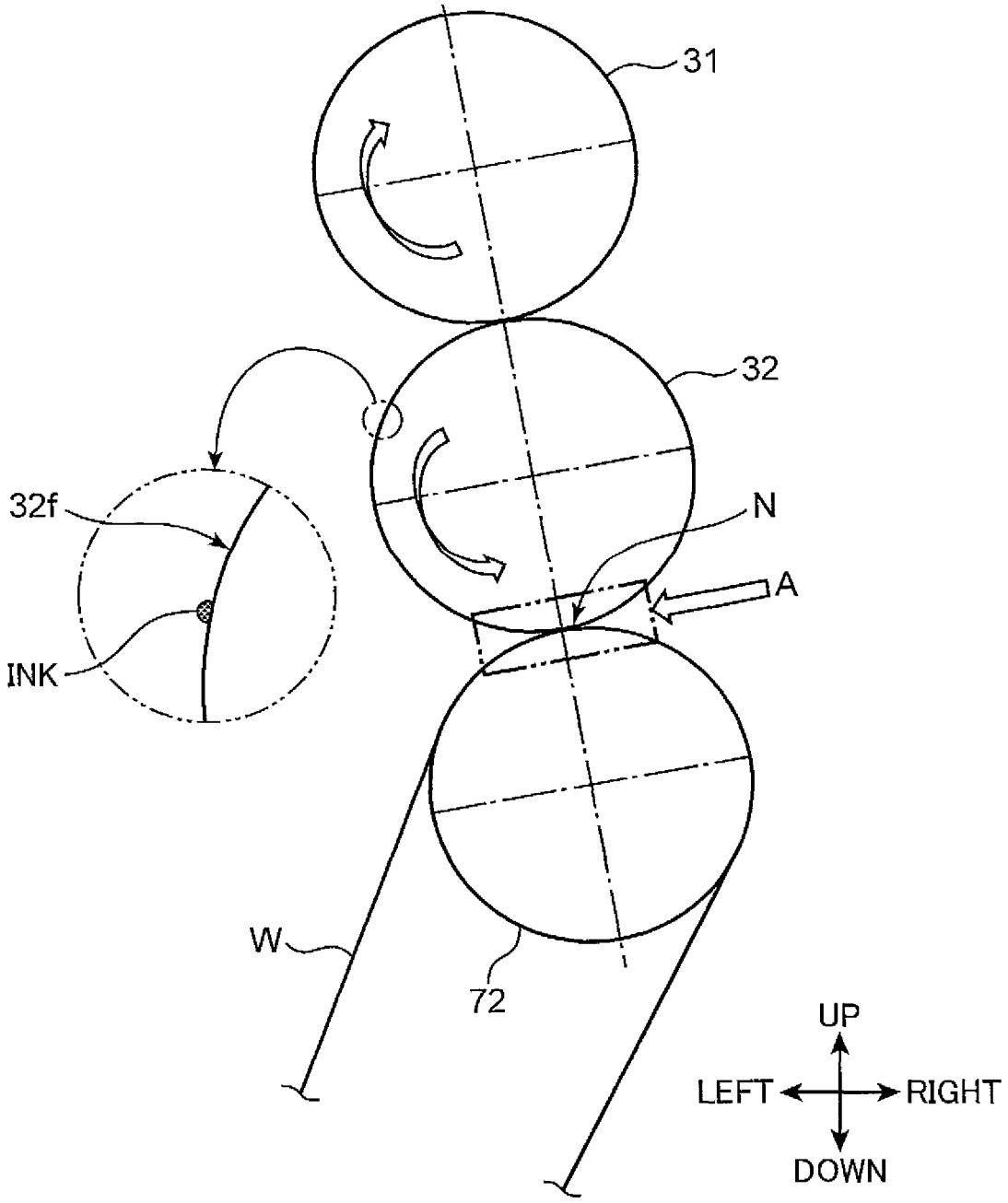
FIG. 10 is a schematic view showing a resist upper roller, a resist lower roller, a pressing roller, and a web.
Figure 11:
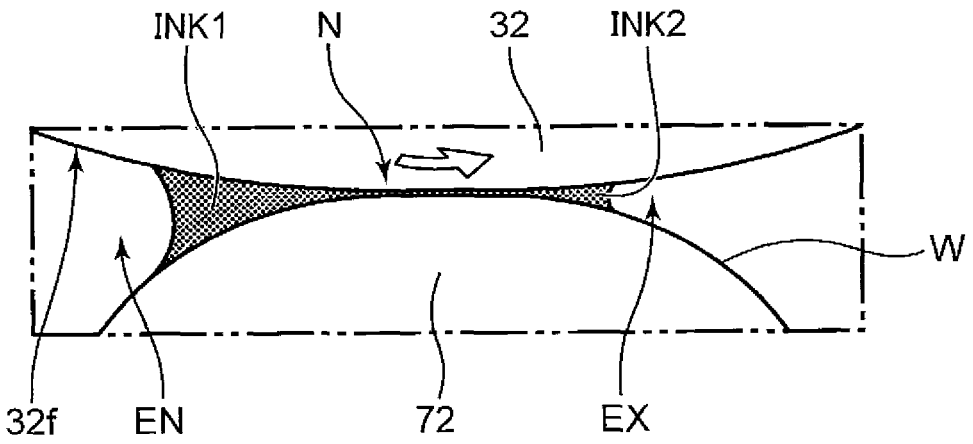
FIG. 11 is a schematic view showing a part where the resist lower roller and the web are in contact with each other.
Figure 12:
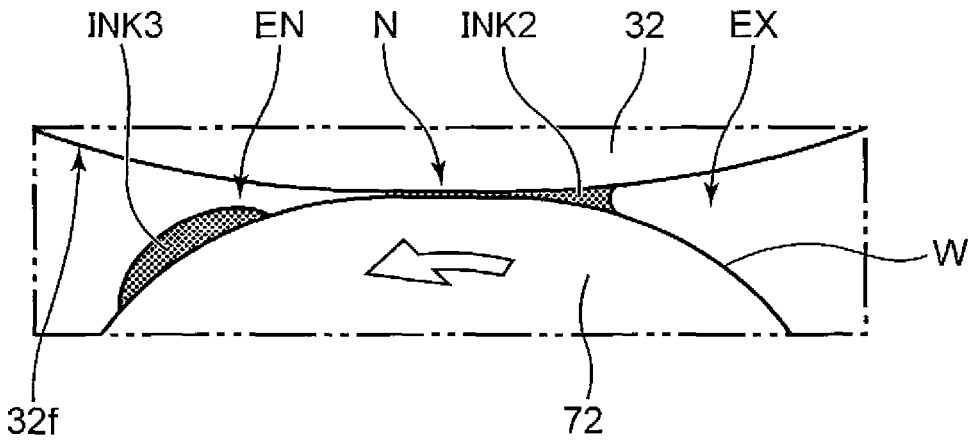
FIG. 12 is a schematic view showing a state where the web is further taken up.

A cleaning process of cleaning the surface of the resist lower roller 32 by the cleaning unit 70 will be described with reference to FIGS. 10 to 12. FIG. 10 is a schematic view showing the resist lower roller 32, the pressing roller 72, and the web W in a state where the cleaning unit 70 is at the cleaning position. FIG. 11 is an enlarged view of a part A shown in FIG. 10, and FIG. 12 shows a state where the web W carrying ink INK3 adhering thereto is taken up further.

As shown in FIG. 10, when the sheet S carrying an image formed on its one surface is reversed to switch its front and back surfaces to each other and is conveyed into the resist roller unit 30, ink INK adheres to a surface 32*f* of the resist lower roller 32 in some cases. The ink INK adhering to the surface 32*f* could remain in a liquid state. As shown in FIG. 11, by rotating the resist lower roller 32, the ink INK adhering to the surface 32*f* is guided to a nip entrance EN of a cleaning nip N formed between the pressing roller 72 and the resist lower roller 32, where the web W is pressed by the pressing roller 72 to come in contact with the resist lower roller 32 (ink INK1). The ink INK1 is then blocked at the nip entrance EN, thus forming an ink puddle there. Afterward, as shown in FIG. 12, the ink INK1 puddling at the nip entrance EN adheres to the web W, and is carried away by the web W as the web W moves forward (ink INK3).

It should be noted, however, that in some cases, part of the ink INK passes through a contact area between the resist lower roller 32 and the web W and reaches a nip exit EX of the cleaning nip N (ink INK2). Specifically, there may be a case where the ink INK1, due to its surface tension, infiltrates into a tiny gap between the pressing roller 72 and the web W and slips through the cleaning nip N. In the present embodiment, a material of the web W (surface contact angle with the ink) is properly selected so that even if the ink INK2 having passed through the contact area arises, the ink INK2 is caused to adhere to the web W. This fact will be described in detail later.

When a cleaning process as described above is completed, the web drive roller 73 is rotatably driven (see FIG. 6) to feed out the web W. This creates a state where at the next round of the cleaning process, a new part of the surface of the web W is allowed to come in contact with the resist lower roller 32.

<Contact Angle of Web Surface with Ink>

Figure 13:
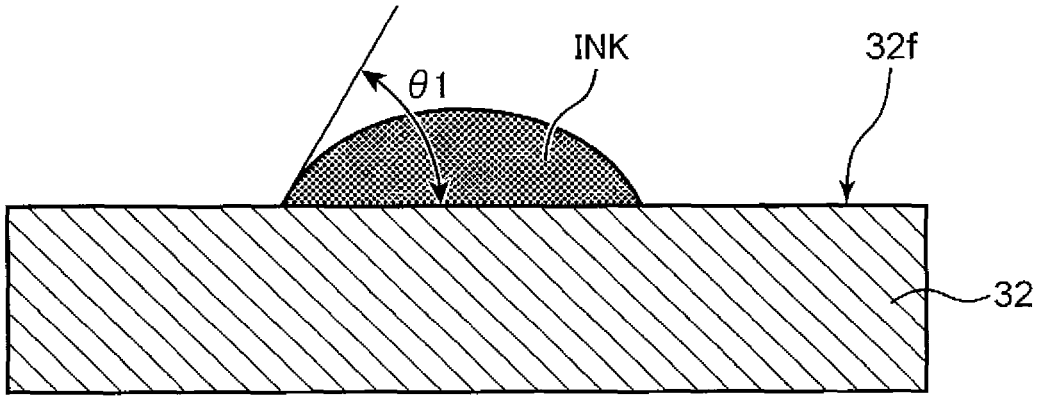
FIG. 13 is a schematic view showing a state of ink on a surface of the resist lower roller.

A contact angle θ2 of a web surface Wf (contact surface) of the web W with the ink INK will be described by comparing the contact angle θ2 with a contact angle θ1 of the roller surface 32*f* of the resist lower roller 32 with the ink INK. FIG. 13 is a schematic view showing a state of the INK on the roller surface 32*f* of the resist lower roller 32, and FIG. 14 is a schematic view showing a state of the INK on the web surface Wf of the web W.

As shown in FIG. 13, a contact angle of the roller surface 32*f* with the ink INK, the roller surface 32*f* being the outer peripheral surface of the resist lower roller 32, is the contact angle θ1. In the present embodiment, the contact angle θ1 is set as a proper contact angle of, for example, 50 degrees or more.

Figure 14:
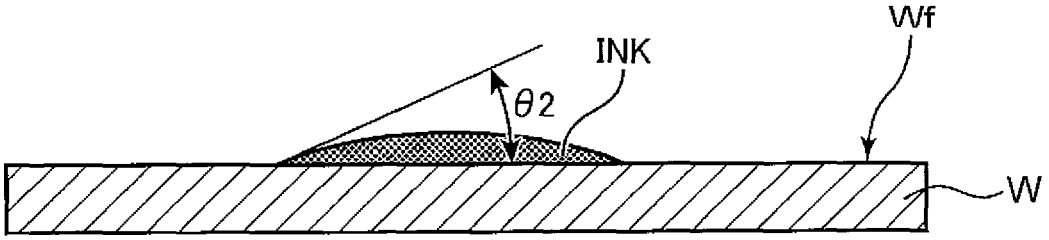
FIG. 14 is a schematic view showing a state of the ink on a surface of the web.

Meanwhile, as shown in FIG. 14, a contact angle of the web surface Wf with the ink INK, the web surface Wf being the surface of web W that comes in contact with the resist lower roller 32, is the contact angle θ2. In the present embodiment, the contact angle θ2 is set as a proper contact angle of, for example, 30 degrees or less.

As described above, in the present embodiment, the contact angle θ1 and the contact angle θ2 have a relationship defined by the following (inequality 1).

$$\theta 2 < \theta 1 \qquad \text{(Inequality 1)}$$

In other words, the contact angle θ2 is set as an angle smaller than the contact angle θ1. It is preferable that a difference between the contact angle θ1 and the contact angle θ2 be determined to be 20 degrees or more, more preferably, be 30 degrees or more. To put it in another way, the above (inequality 1) represents a fact that wettability of the web surface Wf of the web W according to the present embodiment to the ink INK is set higher than wettability of the roller surface 32*f* of the resist lower roller 32 to the ink INK.

<Effects>

The cleaning unit 70 (cleaning device) according to the first embodiment is a cleaning mechanism that cleans the roller surface (surface) 32*f* of the resist lower roller (sheet conveyance member) 32 included in the resist roller unit 30 (sheet conveyance unit) that conveys the sheet S to the image forming unit 50. At the image forming unit 50 of the image forming apparatus 1 according to the present embodiment, the image forming processing is carried out, using the water-based ink (liquid recording material) INK. The cleaning unit 70 has the web W (cleaning member) that can come in contact with the roller surface 32*f* of the resist lower roller 32.

In the present embodiment, the liquid ink INK adheres to the roller surface 32*f* of the resist lower roller 32 in some cases. When the ink INK adheres to the roller surface 32*f*, however, the contact angle θ1 and the contact angle θ2 satisfy the above (inequality 1) to have the relationship defined thereby. As a result, on a part where the ink INK comes in contact with the resist lower roller 32 and with the web W, the ink INK is absorbed by the web W. Therefore, not only the ink INK1 blocked at the cleaning nip entrance EN but also the ink INK2 having slipped through the cleaning nip N between the resist lower roller 32 and the pressing roller 72 is carried away by the web surface Wf of the web W without staying on the roller surface 32*f* of the resist lower roller 32. Hence the occurrence of a problem with an image, such as an image stained with foreign matter, is suppressed.

In the present embodiment, the water-based ink INK is used as the recording material. Because the water-based ink is a conductive liquid, the ink INK adhering to the roller surface 32*f* of the resist lower roller 32 cannot be wiped away by the conventional technique described as a background art. According to the present embodiment, however, the web W that satisfies the above (inequality 1) is adopted as the cleaning member. Even when the water-based ink, which is a conductive liquid, is used as the recording material, therefore, the ink INK adhering to the roller surface 32*f* of the resist lower roller 32 is absorbed by (caused to adhere to) the web W. Thus, when the water-based ink INK adheres to the roller surface 32*f* of the resist lower roller 32, the water-based ink INK can be certainly wiped away by the web W.

The contact angle θ1 of the roller surface 32*f* of the resist lower roller 32 with the ink INK is set as, for example, 50 degrees or more, and the contact angle θ2 of the web surface Wf of the web W with the ink INK is set as, for example, 30 degrees or less. In this manner, according to the present embodiment, the web W having the web surface Wf with high wettability to the roller surface 32*f* is adopted. As a result, the ink INK adhering to the roller surface 32*f* of the resist lower roller 32 can be certainly absorbed by (be caused to adhere to) the web W.

The web W according to the present embodiment has the part that comes in contact with the roller surface 32*f* of the resist lower roller 32, and at least this part is made of a material containing a polyethylene (PE) aramid fiber. This part contains the PE aramid fiber of 20% by mass or more, and more preferably, the same of 40% by mass or more. Adopting the web W containing the PE aramid fiber achieves the high wettability of the web W.

The image forming apparatus 1 according to the present embodiment is the image forming apparatus that includes the sheet reversing unit 15 to offer the both-side printing function. In both-side printing, the ink INK of an image formed by preceding image forming processing is apt to adhere to the roller surface 32*f* of the resist lower roller 32. As described above, however, the web W can certainly wipe away the ink INK adhering to the roller surface 32*f* of the resist lower roller 32.

As described above, in the cleaning unit 70 and the image forming apparatus 1 including the cleaning unit 70, according the present embodiment, even when the ink (recording material) INK adheres to the roller surface (surface) 32*f* of the resist lower roller (sheet conveyance member) 32, the adhering ink INK can be absorbed by (be caused to adhere to) the web (cleaning member) W to clean the roller surface 32*f*.

Second Embodiment

Figure 15:
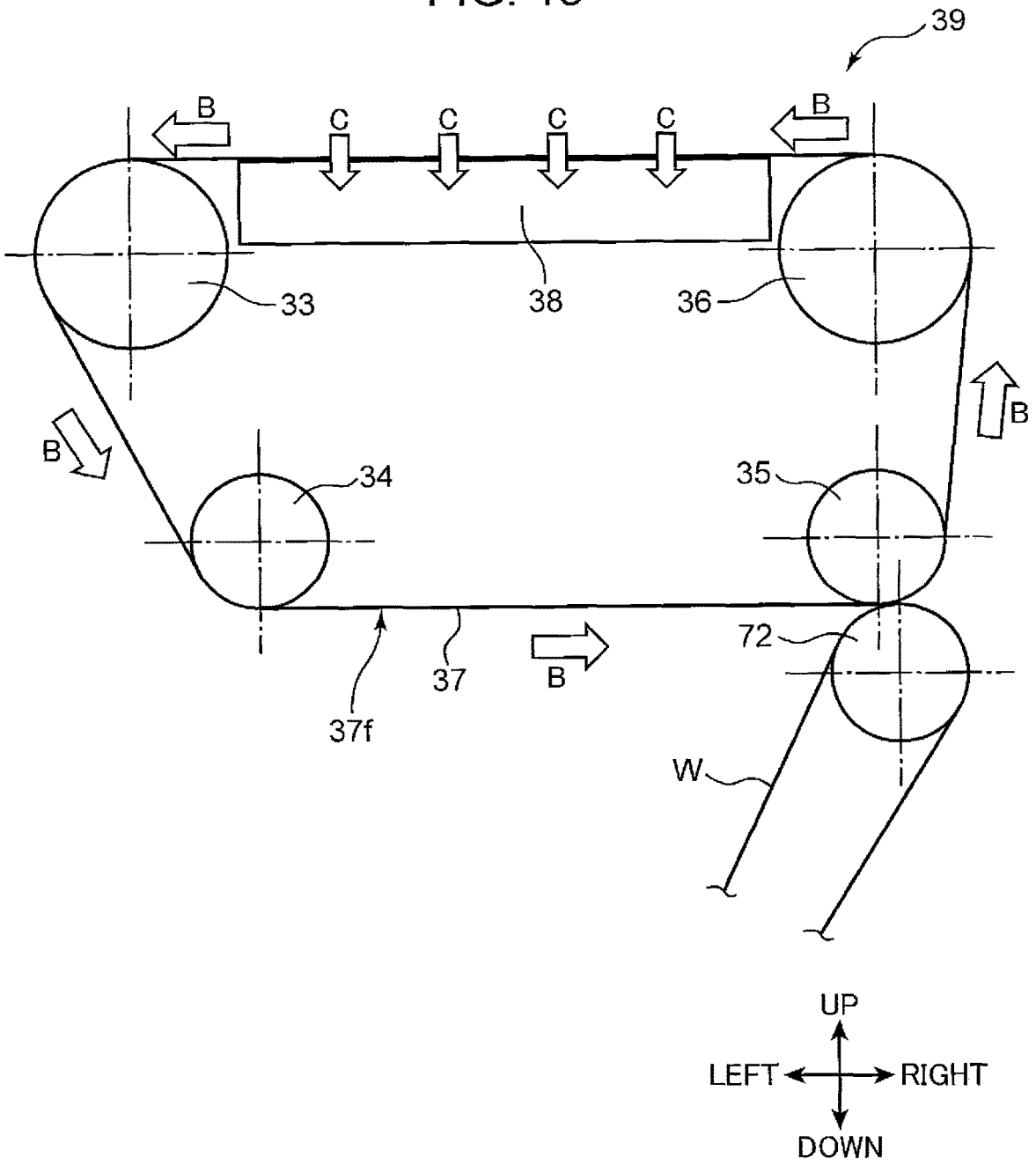
FIG. 15 is a schematic view showing a structure of a sheet conveyance unit and the cleaning unit in an image forming apparatus according to a second embodiment of the present disclosure.

FIG. 15 shows a sheet conveying unit (sheet conveyance unit) 39 that is a constituent element of an image forming apparatus according to a second embodiment of the present disclosure and that makes the image forming apparatus according to the second embodiment different from the image forming apparatus according to the first embodiment. The image forming apparatus according to the present embodiment is the same in configuration as the image forming apparatus 1 according to the first embodiment, except for the sheet conveyance unit 39 shown in FIG. 15.

In the first embodiment, the resist roller unit 30 is described as an example of the sheet conveyance unit that conveys the sheet S to the belt conveyance unit 40. In the second embodiment, on the other hand, the sheet conveying unit 39 is adopted as another example of the sheet conveyance unit, the sheet conveying unit 39 including a plurality of support rollers (first to fourth support rollers 33 to 36), a feed-out belt 37, and a suction unit 38.

As shown in FIG. 15, the first support roller 33 and the fourth support roller 36 are disposed to be separated from each other across a distance in the left-right direction. The first support roller 33 and the fourth support roller 36 each extend in the front-rear direction (the direction orthogonal to the paper surface in FIG. 15). In the present embodiment, for example, the first support roller 33 is a drive roller and the fourth support roller 36 is a belt speed detection roller.

The second support roller 34 is disposed below the first support roller 33 in a right diagonal direction. The third support roller 35 is disposed below the fourth support roller 36, and is disposed right with respect to the second support roller 34 with a predetermined distance formed between the second support roller 34 and the third support roller 35.

The feed-out belt 37 is supported in an extended manner between the four support rollers 33 to 36 so as to have no slackness. Being driven by the rotation of the first support roller 33, the feed-out belt 37 orbits in a direction indicated by arrows B. Inside an orbital path of the feed-out belt 37, the suction unit 38 having the same configuration as the configuration of the suction unit 43 according to the first embodiment is provided. The feed-out belt 37 has a plurality of holes penetrating the feed-out belt 37 in its thickness direction, which holes will not be described in detail. Through these holes, the sheet S placed on a belt surface (outer peripheral surface) 37*f* of the feed-out belt 37 is sucked in a direction indicated by arrows C.

In a state where the cleaning unit according to the present embodiment is at the cleaning position, the pressing roller 72 presses the support roller 35, with the web W and the feed-out belt 37 sandwiched between the pressing roller 72 and the support roller 35. This brings the belt surface 37*f* of the feed-out belt 37 into contact with the web W.

In the cleaning unit according to the present embodiment, a contact angle of the web surface (contact surface) of the web W with the ink INK is set as a contact angle smaller than a contact angle of the belt surface 37*f* of the feed-out belt 37 with the ink INK. In other words, according to the present embodiment, wettability of the web surface of the web W is higher than wettability of the belt surface 37*f* of the feed-out belt 37.

In this manner, according to the present embodiment, the contact angle of the web surface with the ink INK is set as a contact angle smaller than the contact angle of the belt surface 37*f* of the feed-out belt 37 with the ink INK. Thus, when the liquid ink INK adheres to the belt surface 37*f* of the feed-out belt 37, the ink INK is absorbed by the web W on a part where the ink INK comes in contact with the feed-out belt 37 and with the web W. This, therefore, prevents the ink INK from staying on the belt surface 37*f* of the feed-out belt 37, thus suppressing the occurrence of a problem with an image, such as an image stained with foreign matter.

[Modifications]

The embodiments of the present disclosure have been described above. The present disclosure is, however, not limited to these embodiments but may be embodied as the following modified embodiments.

(1) In the first and second embodiments, the water-based ink INK is adopted as an example of the recording material. The present disclosure, however, is not limited by this. For example, non-water-based ink or toner may also be adopted as the recording material. In a case where toner is adopted as the recording material, if the toner is put into a liquid state on the surface of the sheet conveyance member, the same effect as described above can be achieved.

(2) In the first and second embodiments, the web W is reeled out from the web roll WR and is taken up by the web drive roller 73. The present disclosure, however, is not limited by this. For example, a configuration may be adopted according to which a web of a strip sheet shape is brought into contact with the sheet conveyance member and is replaced with another web at predetermined timing.

(3) In the first and second embodiments, the image forming apparatus 1 including the sheet reversing unit 15 is adopted. According to the present disclosure, however, an image forming apparatus not including the sheet reversing unit may also be adopted. Such an image forming apparatus not including the sheet reversing unit may be configured to allow an operation that the user reverses the sheet carrying an image formed on its one surface and places the reversed sheet on a hand-feeding tray (paper supply tray) to form an image on the other surface. In this case, the recording material may adhere to the sheet conveyance member, as does in the above case. In such a case, however, a cleaning device, such as the cleaning unit 70, certainly eliminates the recording material adhering to the sheet conveyance member.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device that cleans a surface of a sheet conveyance member that conveys a sheet in an image forming apparatus which executes image forming processing, using a liquid recording material, the cleaning device comprising:

a cleaning member having a contact surface configured to be brought into contact with the surface of the sheet conveyance member, wherein a contact angle of the contact surface of the cleaning member with the liquid recording material is smaller than a contact angle of the surface of the sheet conveyance member with the liquid recording material, and wherein the contact angles are indices representing wettability of the liquid recording material relative to the contact surface of the cleaning member and relative to the surface of the sheet conveyance member.

2. The cleaning device according to claim 1, wherein the recording material is water-based ink.

3. The cleaning device according to claim 1, wherein a contact angle of a contact surface of the cleaning member with the recording material is 30 degrees or less, and a contact angle of a surface of the sheet conveyance member with the recording material is 50 degrees or more.

4. The cleaning device according to claim 1, wherein a contact surface of the cleaning member is made of a material containing a PE aramid fiber.

5. The cleaning device according to claim 1, wherein the cleaning member is a web of a strip shape, the web forming the contact surface that comes in contact with a sheet conveyance member, and the cleaning device further comprises:

a pressing roller that presses the web against the sheet conveyance member;

a feed-out roller that feeds out the web so as to cause a part of the web that comes in contact with the sheet conveyance member to shift; and a take-up roller that takes up the web.

6. An image forming apparatus comprising:

an image forming unit that executes image forming processing, using a liquid recording material;

a sheet conveyance unit that conveys a sheet to the image forming unit, the sheet conveyance unit including a sheet conveyance member that comes in contact with the sheet; and the cleaning device according to claim 1.

7. The image forming apparatus according to claim 6, further comprising:

a sheet reversing unit that reverses the sheet carrying an image that is formed on one surface of the sheet at the image forming unit, the sheet reversing unit conveying the reversed sheet having a front surface and a back surface switched to each other, to the sheet conveyance unit, wherein the sheet conveyance member is disposed at a place where the sheet conveyance member comes in contact with the sheet carrying the image formed on the one surface.

* * * * *